US008198815B2

(12) United States Patent
Speer et al.

(10) Patent No.: US 8,198,815 B2
(45) Date of Patent: Jun. 12, 2012

(54) AMALGAM SUPPORT IN AN INDUCTIVELY COUPLED DISCHARGE LAMP

(75) Inventors: Richard S. Speer, Concord, MA (US); Jeffery Serre, Peabody, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 0 days.

(21) Appl. No.: 12/569,315

(22) Filed: Sep. 29, 2009

(65) Prior Publication Data

US 2011/0074277 A1 Mar. 31, 2011

(51) Int. Cl.
*H01J 1/62* (2006.01)
*H01J 63/04* (2006.01)
*H01J 17/04* (2012.01)

(52) U.S. Cl. ..... 313/628; 313/567; 313/627; 313/490; 313/483

(58) Field of Classification Search ..... None
See application file for complete search history.

(56) References Cited

U.S. PATENT DOCUMENTS

| | | | | |
|---|---|---|---|---|
| 4,105,910 | A | 8/1978 | Evans | |
| 4,437,041 | A | 3/1984 | Roberts | |
| 4,622,495 | A | 11/1986 | Smeelen | |
| 5,412,288 | A | 5/1995 | Borowiec et al. | |
| 5,559,392 | A * | 9/1996 | Cocoma et al. | 313/490 |
| 5,598,069 | A * | 1/1997 | van Os et al. | 315/248 |
| 5,717,290 | A | 2/1998 | Shaffer | |
| 5,767,617 | A | 6/1998 | Wharmby et al. | |
| 5,841,229 | A | 11/1998 | Borowiec et al. | |
| 6,137,236 | A | 10/2000 | Michiels et al. | |
| 6,201,347 | B1 * | 3/2001 | Smulders | 313/547 |

* cited by examiner

*Primary Examiner* — Natalie Walford
(74) *Attorney, Agent, or Firm* — Andrew Martin

(57) ABSTRACT

An inductively coupled fluorescent discharge lamp includes a light transmissive envelope having a re-entrant cavity that has an outer surface inside the envelope, and an excitation coil inside the re-entrant cavity, and a spring clip that is attached to the outer surface of the re-entrant cavity by spring action of the spring clip on the outer surface, where the spring clip includes an amalgam. The spring clip may include a layer of the amalgam plated on a surface of the clip, or an amalgam-bearing flag attached to the clip.

18 Claims, 4 Drawing Sheets

AMALGAM SUPPORT IN AN INDUCTIVELY COUPLED DISCHARGE LAMP

BACKGROUND OF THE INVENTION

The present invention is directed to an inductively coupled fluorescent discharge lamp, and more specifically to an amalgam support in such a lamp.

With reference to FIG. 1, a conventional inductively coupled fluorescent discharge lamp 10 may include a light transmissive envelope 12 having a re-entrant cavity 14 with an exhaust tube 16 and an excitation coil 18 inside the re-entrant cavity.

The light output of the inductively coupled fluorescent discharge lamp is dependent on the mercury vapor pressure within the lamp envelope. Alloys of low temperature melting metals that amalgamate with the mercury are often placed within such lamps to regulate the mercury vapor pressure within the lamp. When the lamp is turned on, the lumen output is significantly reduced until the amalgam is heated to a point where it releases sufficient mercury vapor to permit efficient lamp operation. This may require from several to many minutes depending on the lamp construction.

In order to decrease the time to reach efficient operation of the lamp, a starter amalgam may be placed inside the lamp envelope where it will be quickly heated. One technique is to place the amalgam on a closed conductive loop that completely circles the re-entrant cavity in order to allow the loop to couple to the inductive field to heat the amalgam on the loop, such as shown in FIG. 5 of U.S. Pat. No. 4,437,041. One of the problems with this technique is that coupling to the amalgam-bearing loop reduces the efficiency of the plasma coupling.

Another technique is to place the amalgam on a flag that is placed in or near the lamp discharge. The amalgam on the flag is heated by the discharge and releases mercury sufficient to improve starting characteristics of the lamp. As shown in FIG. 1 herein which is an embodiment of the lamp in U.S. Pat. No. 5,412,288, for example, the amalgam is on a wire screen flag 20 where the wire support structure for the flag may be snapped onto an extension of the exhaust tube 16. One of the problems with this technique is the cumbersome manufacturing steps needed to provide an attachment location on the surface of exhaust tube for the support for the amalgam-bearing flag.

FIGS. 2*a-c* depict three other examples of prior art amalgam support arrangements. FIG. 2*a* shows an embodiment of the lamp disclosed in U.S. Pat. No. 5,841,229 in which the support for the flag 20 is held by a coil 22 fit snuggly into the inner diameter of the exhaust tube 16. FIG. 2*b* shows an embodiment of the lamp similar to that disclosed in U.S. Pat. No. 4,622,495. Here, the support for the flag 20 is pressed into a bead of molten glass 24 attached to the outside of the re-entrant cavity. FIG. 2*c* shows a lamp with a glass sealing wire 26 held in place by pressing it into the glass during the mount forming operation. The flag 20 is welded on the glass sealing wire. Each of these arrangements is difficult to manufacture in an automated facility.

U.S. Pat. No. 4,105,910 discloses a wire ring for holding laminar segments of an amalgam in a wire mesh on a glass stem in a fluorescent lamp that is not inductively coupled. The process for manufacturing this multipart assembly is cumbersome and also difficult to adapt to automated manufacturing. See also, for example, U.S. Pat. Nos. 5,767,617 and 6,137,236.

SUMMARY OF THE INVENTION

An object of the present invention is to provide a novel amalgam support for an inductively coupled discharge lamp that is easily manufactured in an automated facility and avoids the problems of the prior art.

A further object of the present invention is to facilitate manufacture of an inductively coupled fluorescent lamp by providing an amalgam support that is simply clipped onto the outer surface of the re-entrant cavity.

A yet further object of the present invention is to provide a novel amalgam support in an inductively coupled fluorescent discharge lamp, where the lamp includes a light transmissive envelope having a re-entrant cavity that has an outer surface inside the envelope, and an excitation coil inside the re-entrant cavity, and where the amalgam support is a spring clip that is attached to the outer surface of the re-entrant cavity by spring action of the clip on the outer surface, where the spring clip includes an amalgam layer and/or amalgam-bearing flag.

These and other objects and advantages of the invention will be apparent to those of skill in the art of the present invention after consideration of the following drawings and description of preferred embodiments.

DESCRIPTION OF PREFERRED EMBODIMENTS

Figure 1:
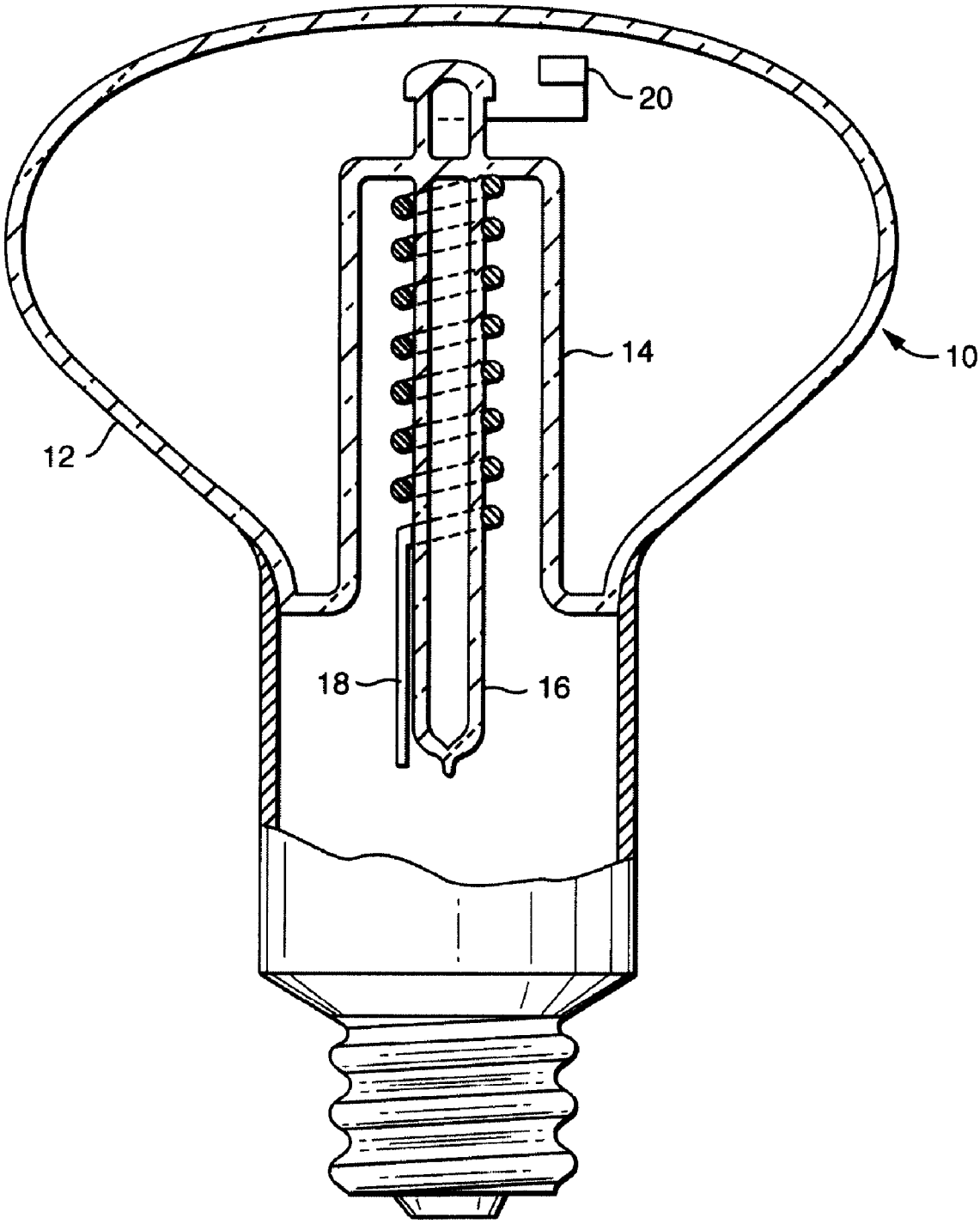
FIG. 1 (PRIOR ART)
FIG. 1 is a cut-away view of an inductively coupled fluorescent discharge lamp of the prior art.
Figure 2C:
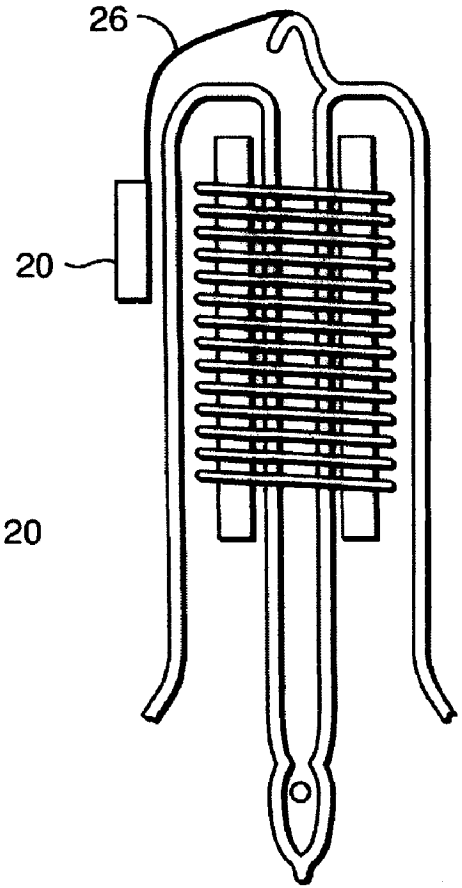
FIG. 2C (PRIOR ART)
FIGS. 2*a-c* are partial, cut-away views of prior art lamps.
Figure 2B:
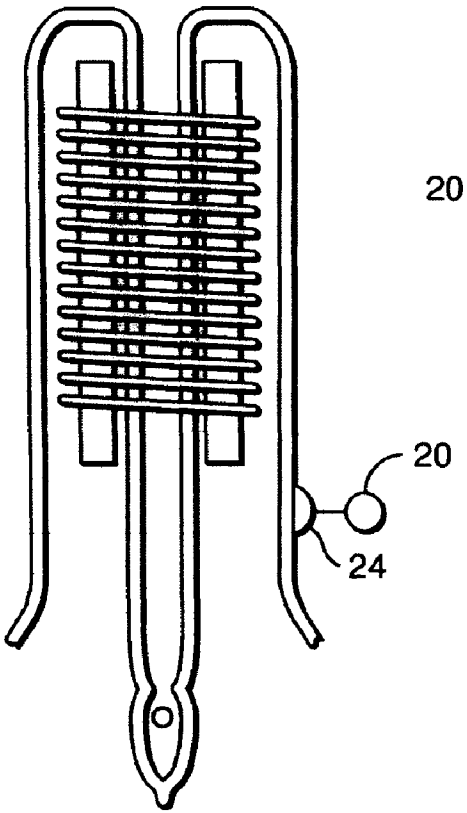
FIG. 2B (PRIOR ART)
Figure 2A:
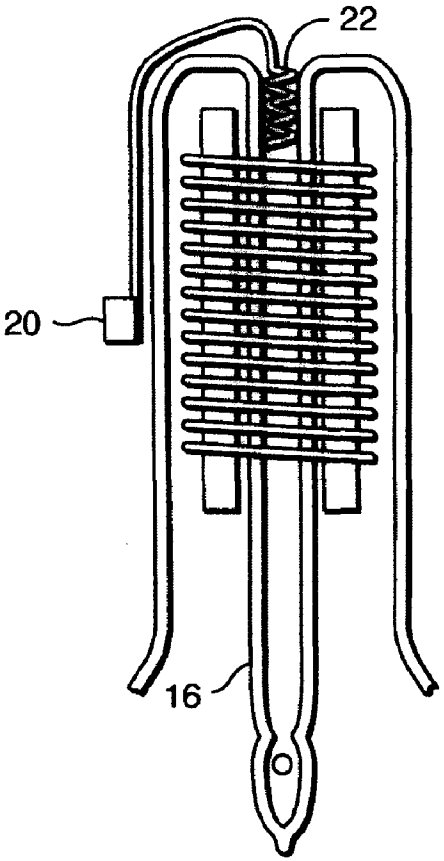
FIG. 2A (PRIOR ART)
Figure 3:
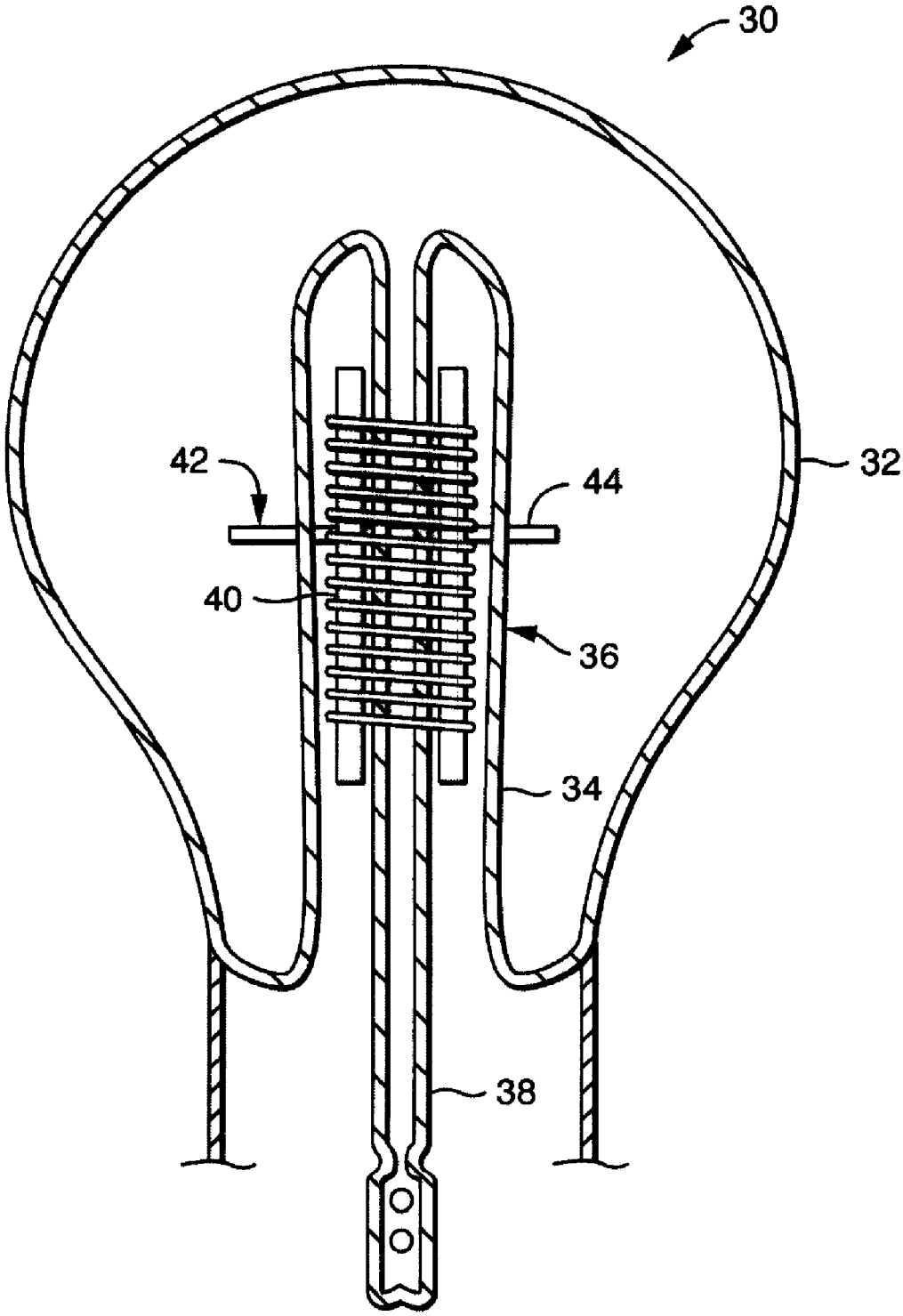
FIG. 3 is a partial pictorial representation of an embodiment of the present invention.

With reference now to FIG. 3, an inductively coupled fluorescent discharge lamp 30 of one embodiment of the present invention includes a light transmissive envelope 32 having a re-entrant cavity 34, where the re-entrant cavity 34 has an outer surface 36 inside the envelope 32. An exhaust tube 38 is inside the re-entrant cavity 34 and opens to an inside of the envelope. An excitation coil 40 is also in the re-entrant cavity. An amalgam 42 is provided on a metallic C-shaped spring clip 44 on the outer surface 36 of the re-entrant cavity 34, where the spring clip 44 is attached to the outer surface by a spring action of the spring clip on the outer surface of the re-entrant cavity. ("C-shaped" means not a closed circle; having a gap in the metal forming the clip through which the re-entrant cavity fits when placing the clip onto the re-entrant cavity by overcoming the spring force of clip. The open C-shape is meant to avoid coupling to the induction field.)

Depending on the location of the clip relative to the plasma that is present inside the envelope when the lamp is operating, the spring clip 44, and thus the amalgam, is heated either by the plasma or by conduction from the re-entrant cavity. When the spring clip 44 is positioned so that the amalgam 42 is not in or near the plasma, the amalgam is heated primarily by conduction of heat from the re-entrant cavity 34. In an exemplary lamp, the re-entrant cavity operates at about 200° C. when the lamp is fully warmed up. As the glass of the re-entrant cavity heats up, the clip heats up as well, thereby vaporizing the mercury in the amalgam. The rate of delivery of the mercury may be controlled by the position of the clip within the envelope. When the clip is located above or below the excitation coil (not overlapping the coil) and away from the hotter regions near the plasma, the clip will heat up more slowly and thus the delivery rate of the mercury will decrease. When the spring clip 44 is positioned so that the amalgam 42 is located within or near the plasma, the clip will heat up quickly and the mercury delivery rate will increase. This ability to control the mercury delivery rate by selective positioning of the spring clip along the length of the re-entrant cavity during the manufacturing process makes the spring clip technique particularly versatile in automated manufacturing facilities.

In a preferred embodiment, the spring clip 44 is a wire made of an austenitic nickel-chromium-based superalloy, such as Inconel®. The material of the spring clip should retain its spring at the temperature to which it is exposed when placed on the re-entrant cavity and the lamp is operating. A spring clip made of Inconel will retain its spring at temperatures exceeding 500° C. By way of example, an Inconel wire used to make the clip may have an outer diameter of about 0.02" to 0.04". Other similar materials may also be used for the clip, e.g., 316 stainless steel. The clip may further include at least one of indium, gold and silver that forms the amalgam 42. Other amalgam materials may also be used.

Figure 4:
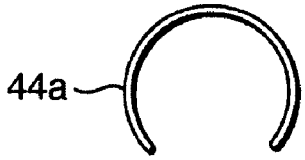
FIG. 4 is a plan view of a first embodiment of a spring clip used in the present invention.
Figure 5:
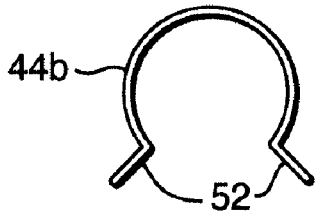
FIG. 5 is a plan view of a second embodiment of a spring clip used in the present invention.
Figure 6:
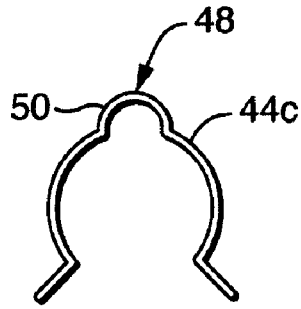
FIG. 6 is a plan view of a third embodiment of a spring clip used in the present invention.
Figure 6A:
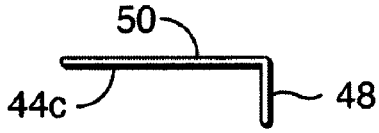
FIGS. 6*a* and 6*b* are a side and end view, respectively, of the third embodiment.
Figure 6B:
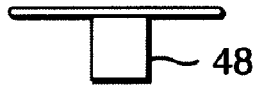
Figure 7:
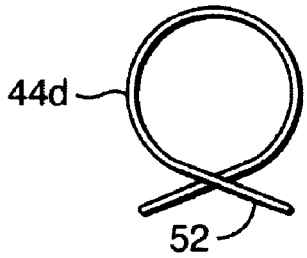
FIG. 7 is a plan view of a fourth embodiment of a spring clip used in the present invention.
Figure 7A:
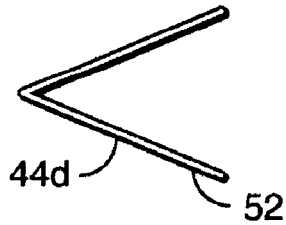
FIG. 7*a* is a side view of the fourth embodiment.

With reference to FIGS. 4-7, the spring clip 44 may take different shapes. FIG. 4 shows a C-shaped clip 44*a* with no extensions. FIG. 5 shows an embodiment in which the spring clip 44*b* has distal ends 52 that extend outwardly away from the outer surface 36 of the re-entrant cavity 34 (the distal ends may be in co-planar with the body of the clip or diverge therefrom.) The distal ends may extend outwardly so as to be positioned for exposure to the desired temperature. The outwardly extended distal ends 52 each may include a layer of the amalgam plated on a surface thereof, and optionally a part of the clip between the distal ends does not include the amalgam depending on how much amalgam is needed and other factors such as the delivery rate. In the embodiment of FIG. 6 (shown in side and end views in FIGS. 6*a*-6*b*), an amalgam-bearing flag 48 is attached to the spring clip 44*c*. The flag 48 may be conventional (e.g., stainless steel ribbon coated with the amalgam) and may be welded to the clip. The spring clip 44*c* may have a raised portion (or handle) 50 that is spaced from the outer surface 36 of the re-entrant cavity, where the flag 48 is attached to the raised portion 50. In a further embodiment in FIG. 7 (shown in a side view in FIG. 7*a*), the spring clip 44*d* is coiled (i.e., extending more than 360° but not in one plane) and mounted on the outer surface of the re-entrant cavity by pushing the distal ends of the clip apart and sliding the clip over the top of the re-entrant cavity. The distal ends may extend outwardly as in the previous embodiment.

The spring clip 44 may carry the amalgam on a flag as noted above, and/or the spring clip 44 may include a layer of the amalgam 42 plated on a surface of the clip. In the latter embodiment, the layer may be plated on an entirety of the clip. In the example noted above, the Inconel wire was coated with 0.2-0.4 mg of indium to form the plated layer. The spring clip with the flag may also be plated with amalgam to provide a further location for the amalgam.

The amalgam-bearing spring clip offers several advantages in the manufacturing process. The clip-coating and/or flag welding can be carried our separately and the thus-assembled spring clip can be easily stored and shipped. Assembly of the lamp is further simplified because the spring clip can be clipped onto the re-entrant cavity at or near the end of fabrication of the re-entrant cavity. In contrast to the prior art, there is no need to add an extension to the fragile glass that forms the re-entrant cavity during its manufacture, and no glass-to-metal joining. Further, in some embodiments, the flag assembly is not needed at all, thereby further simplifying the process. When the flag is not used, the outwardly extended amalgam-bearing distal ends take the place of the flag and offer yet a further option for selectively positioning the amalgam within the envelope of the lamp.

While embodiments of the present invention have been described in the foregoing specification and drawings, it is to be understood that the present invention is defined by the following claims when read in light of the specification and drawings.

We claim:

1. An inductively coupled fluorescent discharge lamp, comprising:

a light transmissive envelope having a re-entrant cavity and an exhaust tube, said re-entrant cavity having an outer surface inside said envelope and external to said exhaust tube;

an excitation coil within said re-entrant cavity; and a spring clip on said outer surface of said re-entrant cavity and attached to said outer surface by a spring action of said clip completely on said outer surface, said clip comprising an amalgam.

2. The lamp of claim 1, wherein said clip comprises a layer of said amalgam plated on a surface of said clip.

3. The lamp of claim 1, wherein said layer is plated on an entirety of said clip.

4. The lamp of claim 1, further comprising a flag attached to said clip, said flag containing said amalgam.

5. The lamp of claim 4, wherein said clip further comprises a layer of said amalgam plated on a surface of said clip.

6. The lamp of claim 4, wherein said clip is C-shaped and has a first portion that is spaced from said outer surface of said re-entrant cavity, and wherein said flag is attached to said first portion.

7. The lamp of claim 1, wherein said clip has distal ends that extend outwardly away from said outer surface of said re-entrant cavity.

8. The lamp of claim 7, wherein said outwardly extended distal ends each comprises a layer of said amalgam plated on a surface thereof.

9. The lamp of claim 1, wherein said amalgam is located within a plasma that is present within the envelope while the lamp is operating.

10. The lamp of claim 1, wherein said clip comprises an austenitic nickel-chromium-based superalloy.

11. The lamp of claim 10, wherein said clip further comprises at least one of indium, gold and silver that forms said amalgam.

12. The lamp of claim 1, wherein said clip is attached to said outer surface of said re-entrant cavity at a location not overlapping said excitation coil.

13. The lamp of claim 1, wherein said clip is C-shaped.

14. The lamp of claim 1, wherein said clip is coiled.

15. The lamp of claim 14, wherein said clip has distal ends that extend outwardly away from said outer surface of said re-entrant cavity.

16. The lamp of claim 15, wherein said outwardly extended distal ends each comprises a layer of said amalgam plated on a surface thereof.

17. An inductively coupled fluorescent discharge lamp, comprising:

a light transmissive envelope having a re-entrant cavity, said re-entrant cavity having an outer surface inside said envelope;

an excitation coil within said re-entrant cavity; and a spring clip on said outer surface of said re-entrant cavity and attached to said outer surface by a spring action of said clip completely on said outer surface that is located external to an exhaust tube of the light transmissive envelope, said clip comprising an amalgam.

18. An inductively coupled fluorescent discharge lamp, comprising:

a light transmissive envelope having a re-entrant cavity, said re-entrant cavity having an outer surface external to said exhaust tube and inside said envelope;

an excitation coil within said re-entrant cavity; and a spring clip on said outer surface of said re-entrant cavity and directly attached to said outer surface by clasping to only said outer surface, said clip comprising an amalgam.

* * * * *